United States Patent [19]

Beckish

[11] 4,280,701

[45] Jul. 28, 1981

[54] GOLF SWING TRAINING DEVICE

[76] Inventor: John Beckish, 228 W. Mitchell St., Milwaukee, Wis. 53207

[21] Appl. No.: 167,686

[22] Filed: Jul. 11, 1980

[51] Int. Cl.[3] ..... A63B 69/36

[52] U.S. Cl. ..... 273/191 A; 273/186 C

[58] Field of Search ..... 434/252; 273/191 R, 273/191 A, 191 B, 186 R, 186 C, 188 R, 188 A

[56] References Cited

U.S. PATENT DOCUMENTS

| | | | |
|---|---|---|---|
| 3,341,208 | 9/1967 | Marcella | 273/191 A |
| 3,795,399 | 3/1974 | Beckish | 273/191 A |
| 4,071,251 | 1/1978 | Beckish | 273/191 A |

*Primary Examiner*—George J. Marlo

*Attorney, Agent, or Firm*—Richard P. Ulrich

[57] ABSTRACT

A golf swing training device which dynamically controls the user's backswing plane and his downswing plane during his golf swing. The device comprises an arcuate open ring which moves in synchronism with the golfer's swing and to which the golf club is attached. The correct backswing plane is established initially and is modified by the device as the backswing occurs by moving the ring to the golfer's left and the backswing end of the ring rearward thereby establishing the correct downswing plane which is retained until the swing is completed. After completion of the swing, the machine restores the ring to its original position. Movement of the ring is controlled by a system including four vertical posts each of which is mounted on its own movable carrier, two timing devices, compressed air actuators, and a whisker switch sensing element which is closed by the user's golf club as the club is moved away from the ball during the backswing.

8 Claims, 5 Drawing Figures

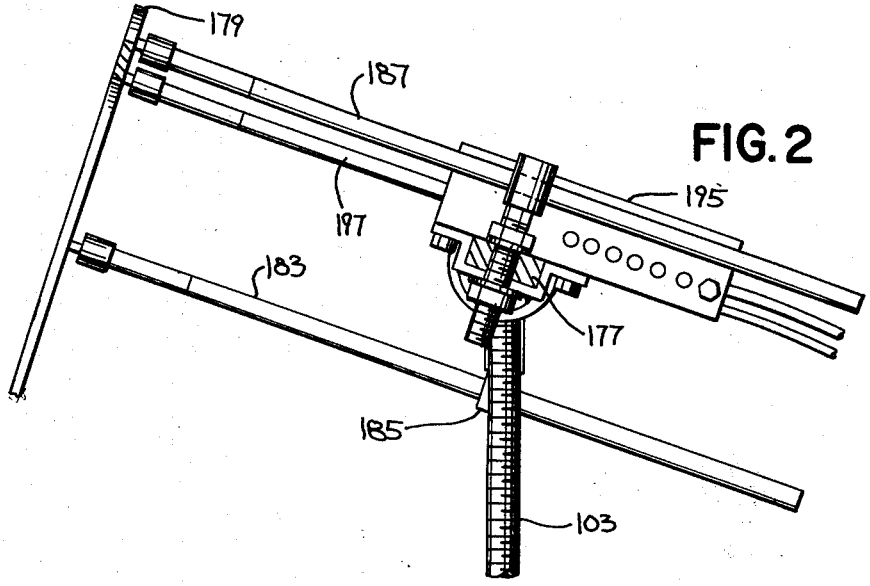
FIG. 2
FIG. 3
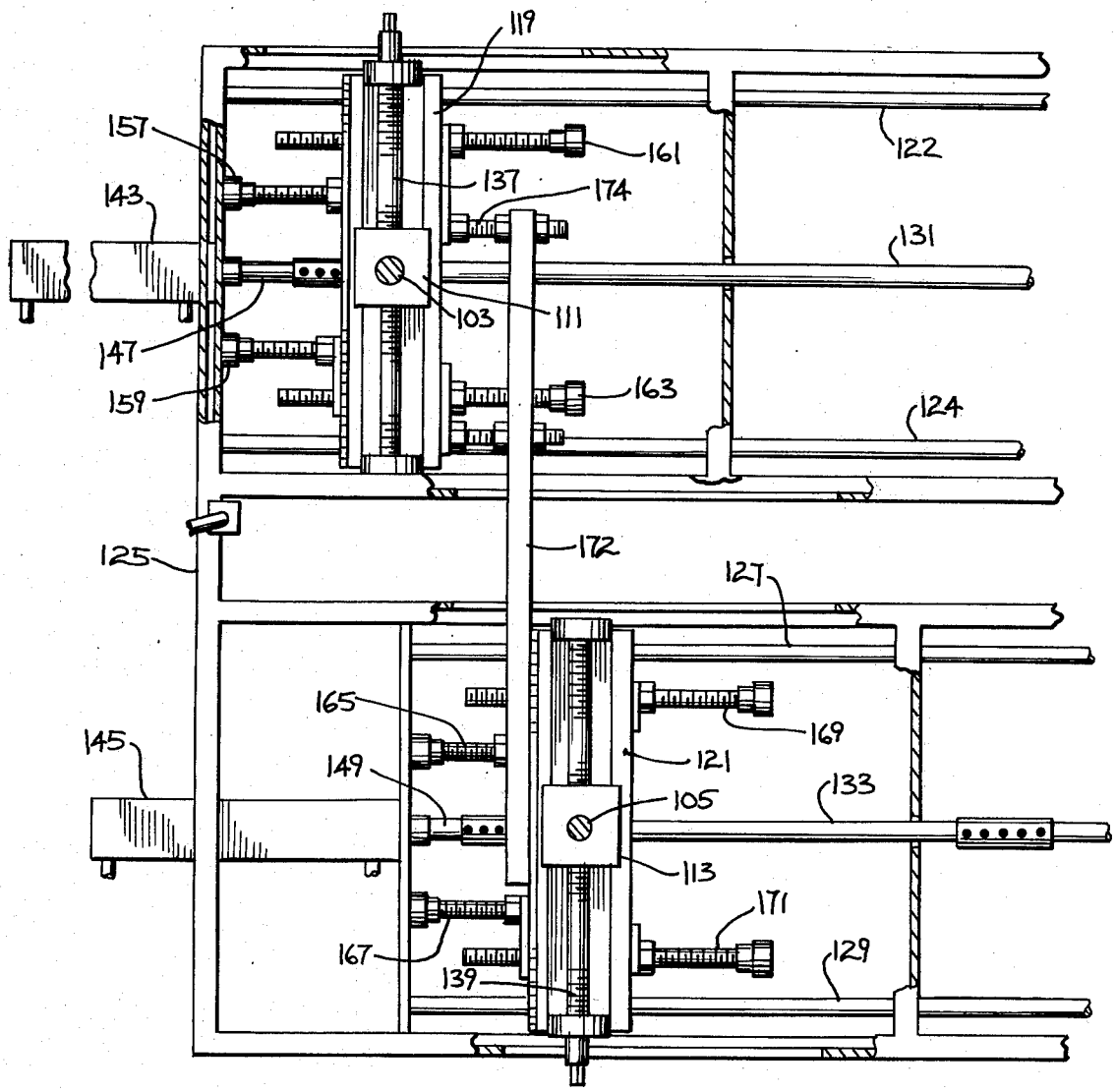

FIG. 4
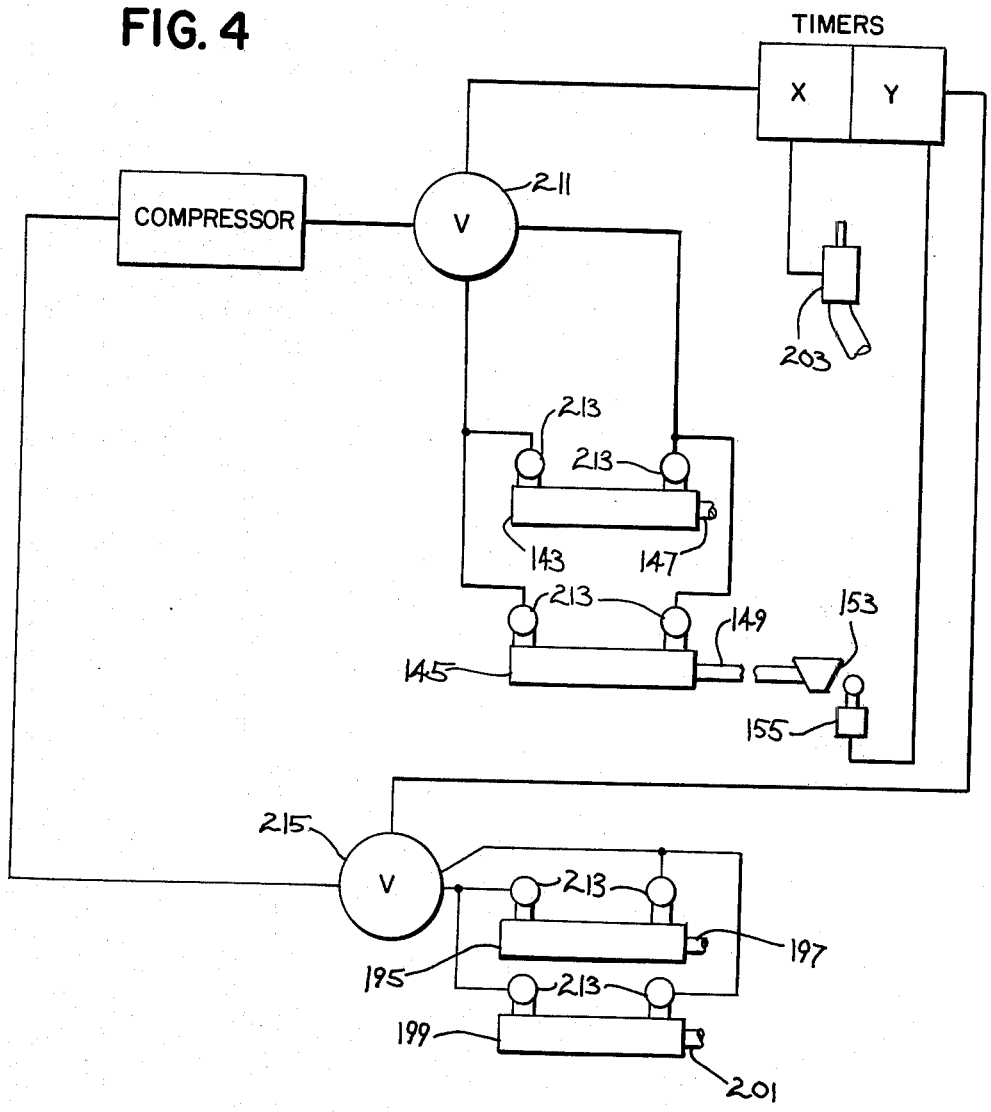
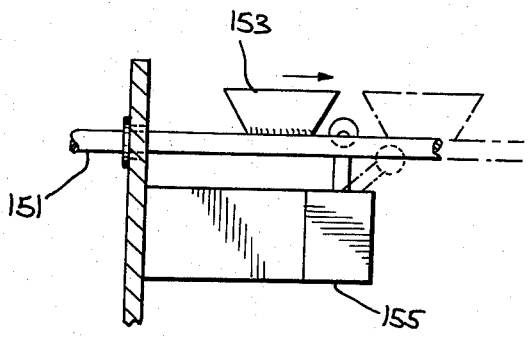
FIG. 5

GOLF SWING TRAINING DEVICE

SUMMARY OF THE INVENTION

This invention relates to golf swing practice and training devices which have a defined path along which the club must proceed.

This device is an improvement of the golf swing training device described in my earlier U.S. Pat. No. 3,795,399. Since that patent issued, I have discovered that many good golf swings describe different arcs on the foreswing and the backswing.

In the literature describing golf swings, the phrase "the line" means the imaginary line which passes through the ball and the target. The area on the golfer's side of the line is defined as "inside the line" while the area on the other side of the line is defined as "outside the line". When the head of a golf club approaches the ball "from the inside" what is meant is that the club head remains on the golfer's side of the line until impact. The "address position" is defined as the position assumed by the golfer when he is ready to begin his swing.

In the description of the golf swing and how to use the device which follows, it is assumed that the user is right handed. Left handed persons will have to make adjustments so that the description applies to them.

When a golfer moves a golf club from the address position to the top of the backswing, he shifts his weight so that he has more weight on his right foot than he has on his left foot. Simultaneously, his shoulders rotate on a plane which is roughly horizontal while his hands raise the club to a position which is to the right of his head and well inside the line. However, to initiate the foreswing, the body's weight must be shifted to the left foot without allowing the head to move. Since the head and feet are anchored, the only way to shift the body's weight to the left is to shift the hips to the left. When the hips move left, the right shoulder must drop if the head does not move. When the right shoulder drops, the right elbow is forced into the right side and the left shoulder moves upward. This movement of the shoulders on the downswing is roughly in a vertical plane. Since the shoulder is attached to the arm, and the arm to the club, the arc described by the head of the club is different on the foreswing from the arc described by the head of the club on the backswing. Specifically, when the clubhead leaves the ball on the backswing, it moves inside the line on a shallower angle than the angle the clubhead assumes with respect to the line as it approaches the line on the downswing.

Recognizing that the path traversed by the clubhead on the backswing is different from the path traversed by the clubhead on the foreswing, I provide for a change in the position of the guide ring of this invention dynamically so that the path that the clubhead is required to follow conforms to the desired path on the downswing and the backswing.

In addition to dynamically varying the position of the ring, I provide means for adjusting the device according to the size of the user, the desired swing plane, the speed of his backswing and foreswing, the position of the golfer with respect to the ball at address, how much he moves his hips when shifting weight, and many others.

DESCRIPTION OF THE DRAWINGS

FIG. 2 is a sectional view in direction 2—2.

FIG. 3 is a partial top view of the device in direction 3—3.

FIG. 4 is a schematic diagram of the actuators, valves and timers of the device.

FIG. 5 shows a limit switch which senses the leftward position of the ring.

DESCRIPTION OF THE PREFERRED EMBODIMENT

Figure 1:
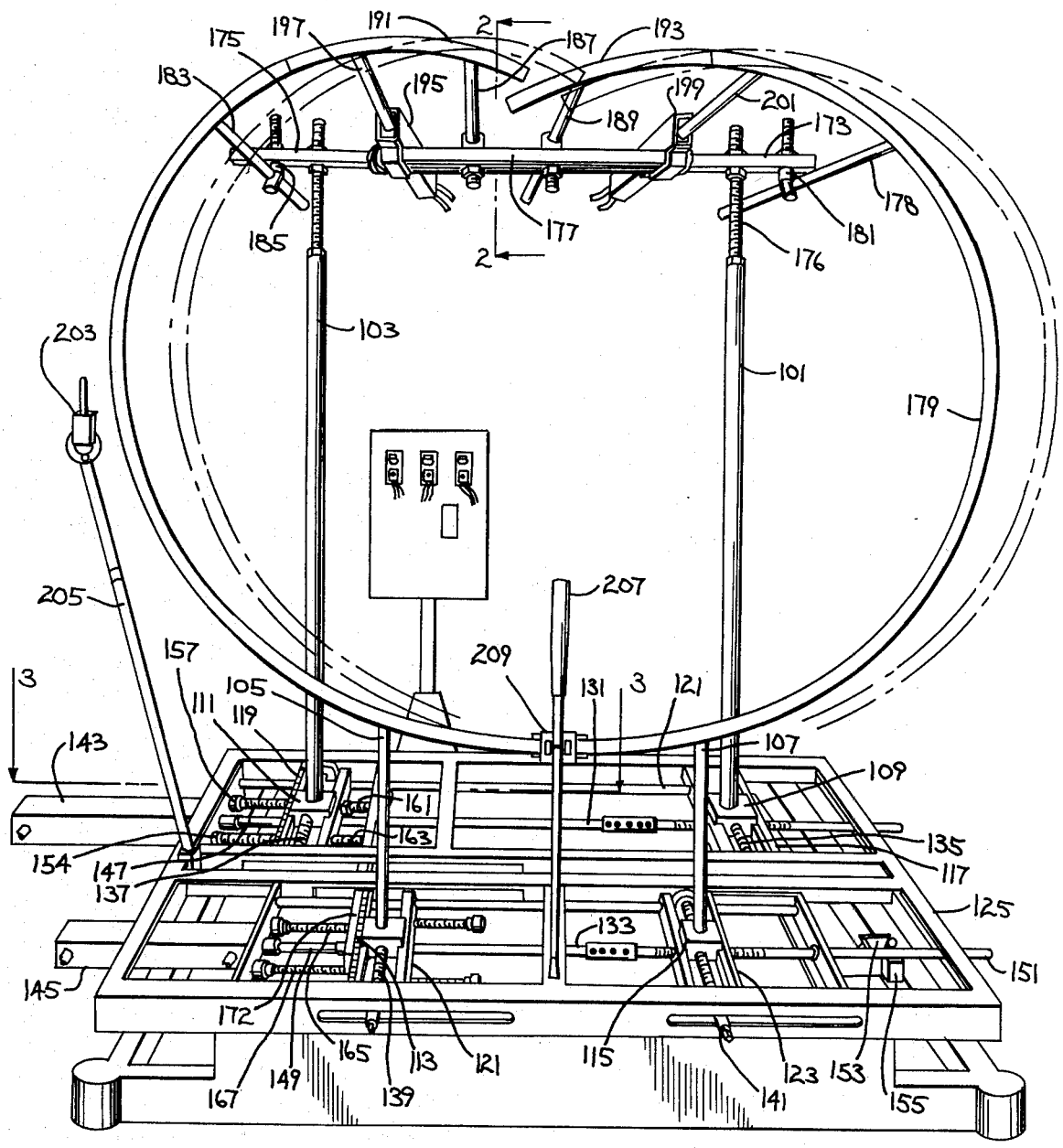
FIG. 1 is a front view of the device.

With reference to the figures, vertical posts 101, 103, 105 and 107 are mounted respectively on slides 109, 111, 113 and 115 which are in turn slidably mounted on carriers 117, 119, 121 and 123. Carriers 117 and 119 are jointly mounted on bearing rods 122 and 124 which are in turn attached to base 125. Carriers 121 and 123 are jointly mounting on bearing rods 127 and 129 the ends of which are also attached to base 125. Rod 131, the length of which is adjustable, connects carrier 117 to 119. Rod 133, the length of which is adjustable, connects carrier 121 to 123. In this way when carrier 117 is moved to the left carrier 119 is also moved to the left an equal distance. Slide 109 is moved forward and backwards in response to screw 135, slide 111 is moved forward and backward in response to screw 137, slide 113 is moved forward and backward in response to screw 139 and slide 115 is moved forward and backward in response to screw 141. Carriers 117 and 119 move left and right in response to the urging of actuator 143 while carriers 121 and 123 move left and right in response to the urging of actuator 145. The actuators of the device may be operated hydraulically or electrically. In the model, they are operated with compressed air. They comprise a cylinder inside of which is a piston. Compressed air is introduced on one side of the piston and discharged from the other side to move the piston to one end of the cylinder. To return the piston to its original position the process is reversed. Actuator 143 is attached to carrier 119 by rod 147 and actuator 145 is attached to carrier 121 by rod 149. The length of both of these rods is adjustable. Rod 151 is attached to carrier 123 on one end and has limit switch actuator 153 mounted on it intermediate its ends. Actuator 153 closes switch 155 when the carriers have moved to the right a pre-determined distance. Adjustable bumpers 157 and 159 limit the travel of carriers 117 and 119 to the left. Adjustable bumpers 161 and 163 limit the travel of carriers 117 and 119 to the right. Adjustable bumpers 165 and 167 limit the travel of carriers 121 and 123 to the left and adjustable bumpers 169 and 171 limit the travel of carriers 121 and 123 to the right. Stabilizer bar 172 is connected to carrier 121 on one end and to carrier 119 on the other end by adjustment means 174. Stabilizer bar 172 insures that all carriers move simultaneously. Adjustable means 174 controls the offset of carrier 119 with respect to carrier 121.

Crossbar 173 is mounted on the upper end of vertical post 101 and its height above the base may be adjusted with adjustment means 176. Crossbar member 175 is similarly adjustably mounted on the upper end of post 103. Crossbar member 177 is rotatably attached between the left end of member 173 and the right end of member 175. Slide rod 178 is attached to ring 179 on one end and slidable attached to crossbar member 173 on the other end by pivot member 181. Slide rod 183 is attached to ring 179 on one end and slidably attached to crossbar 175 by pivot member 185.

Although the ring is not physically divided into three parts, each end of the ring has been given a separate identification number to aid in describing how the invention works.

Slide rod 187 is attached to backswing end 191 of ring 179 on one end and slidable attached to crossbar 177 on the other end. Slide rod 189 is attached to foreswing end 193 of ring 179 on one end and slidably attached to crossbar 177 on the other end. Backswing end 191 of ring 179 moves forward and backward in response to the urging of actuator rod 197 which is attached to the ring on one end. The other end of rod 197 is controlled by actuator 195. Actuators 197 and 199 are slidably attached to crossbar 177 thereby providing an additional adjustment to accommodate rings of different sizes. In addition, the actuators may be attached underneath crossbar 177 rather than on top of it. Foreswing end 193 of ring 179 moves forward and backward in response to the urging of actuator 199 through rod 201, one end of which is controlled by actuator 199 and the other end of which is attached to ring 179.

Whisker switch 203 is mounted on telescoping post 205. Its position is adjustable. It may be moved so that the switch closes earlier or later in the backswing according to the speed of the user's backswing.

Golf club 207 is mounted in carrier 209. Carrier 209 is slidably mounted on ring 179 so that the golf club can be swung back and forth but is constrained to follow the path dictated by ring 179.

Although this device is described as having actuators 143 and 145, it is contemplated that a single actuator could be used since stabilizer bar 172 ties carriers 119 and 121 together. The design incorporates actuators 143 and 145 to provide increased flexibility. For example, it may prove to be desirable to move carrier 119 a distance which is unequal to the distance moved by carrier 121, or it may become desirable to start the movement of carrier 119 before or after the the movement of carrier 121 starts. These changes are possible simply by removing stabilizer bar 172. Furthermore, the movement of the foreswing end of the ring is not absolutely necessary in all cases and may not be provided in all embodiments of the invention.

FIG. 4 is a schematic diagram of the timers, switches and actuators of the device. When whisker switch 203 closes, it starts timer X and opens valve 211. Valve 211 controls the charging of actuators 143 and 145 with compressed air. (Valves 213 control the rate at which the actuators are charged and discharged.) As actuators 143 and 145 charge, the ring moves to the user's left. When limit switch 155 closes, timer Y starts and operates valve 215. When valve 215 opens, actuators 195 and 199 are charged thereby moving the backswing end of the ring 191 backward and foreswing end 193 forward. When the time for which timer X was set elapses, the ring returns to its original position. When the time for which timer Y was set elapses, the ends of the ring return to their original positions.

OPERATION

To use the device, the user stands inside the ring on a platform (not shown) and grasps the golf club. Initially, the ring is in its extreme rightward position. (the golfer's right). Backswing end 191 of the ring is in its forward position and foreswing end 193 is in its backward position. As the user swings the club away from the ball, he closes whisker switch 203 with his golf club. When whisker switch 203 closes, it starts timer X and opens valve 211 which allows actuators 143 and 145 to charge with air. The actuators in turn move ring 179 to the left. (User's left). The leftward position of the ring is shown schematically with invisible lines in FIG. 1. The movement of the ring to the left occurs as the user's backswing continues. At about the time the foreswing begins, limit switch 155 closes which starts timer Y and energizes actuators 195 and 199. Actuator 195 moves backswing end 191 of the ring rearward and actuator 199 moves the foreswing end of the ring forward thereby setting up the downswing swing plane and forcing the user to follow it. After the ball is struck, the position of the foreswing end of the ring insures that the user will finish with his hands high and to the left of his head.

In addition to the movement of the ring described above, the machine may be statically set-up for the use of many persons. It is contemplated that rings in several sizes will be used with the device to accommodate persons of widely varying stature. To accommodate rings of different size, and to accommodate several swing planes, the members which support the ring and the position of the carriers and slides relative to one another are adjustable.

Since the movement of the ring to the left and to the right and the movement of the ends of the ring in and out is a function of the size of the person using the machine and of his personal preference, the throw of the actuators is adjustable.

The front to back position of the ring on the base is also adjustable to accommodate changes in the address position of the user. That is to say, the distance from the ring to the ball is adjustable.

What is claimed is:

1. A golf swing training device comprising:

(a) a base;

(b) an arcuate open ended ring having a foreswing end and a backswing end;

(c) post means for supporting the ring, said posts being mounted on the base for movement to the left and to the right;

(d) first actuator means for moving the ring to the left and to the right;

(e) second actuator means for moving the backswing end of the ring forward and backward;

(f) first sensing means, responsive to the presence of a golf club, for initiating the motion of the ring to the left;

(g) second sensing means, responsive to the leftward position of the ring, for initiating the motion of the backswing end of the ring;

(h) first timing means, responsive to the first sensing means, for timing the movement of the ring to the right and to the left; and (i) second timing means, responsive to the second sensing means, for timing the movement of the backswing end of the ring forward and backward.

2. The device of claim 1 which further comprises means for moving the posts forward and backward.

3. The device of claim 1 wherein the actuator means for moving the ring to the left and to the right is a compressed air actuator.

4. The device of claim 1 wherein the actuator means for moving the backswing end of the ring forward and backward is a compressed air actuator.

5. The device of claim 1 which further comprises third actuator means, responsive to the second sensing means and controlled by the second timing means, for moving the foreswing end of the ring forwards and backwards.

6. The device of claim 1 which further comprises means for adjusting the distance moved by the ring in response to the actuator means of element 1*d*.

7. The device of claim 1 which further comprises means for adjusting the distance moved by the backswing end of the ring in response to the actuator means of element 1*e*.

8. A golf swing training device which comprises:

(a) a base;

(b) a first and second pair of carriers slidably mounted on the base for horizontal movement;

(c) a first pair of vertical posts mounted on the first pair of carriers and a second pair of posts mounted on the second pair of carriers;

(d) a crossbar member, rotatably attached to the top portion of the first pair of vertical posts;

(e) a plurality of rods which are slidably attached to the crossbar member on one end;

(f) an arcuate opended ring, having a foreswing end and a backswing end, the bottom portion of which is attached to the top of the second pair of posts, the ends of said ring being attached to the other ends of the rods;

(g) first actuator means for moving the first pair of carriers to the left and to the right;

(h) second actuator means for moving the second pair of carriers to the left and to the right;

(i) third actuator means for moving the backswing end of the ring in and out;

(j) fourth actuator means for moving the foreswing end of the ring in and out;

(k) first sensing means, responsive to the presence of a golf club, for energizing the first and second actuator means;

(l) second sensing means, responsive to the leftward position of the carriers, for energizing the third and fourth actuator means;

(m) first timing means, responsive to the first sensing means, for timing the movement of the carriers to the left and to the right; and (n) second timing means, responsive to the second sensing means, for timing the movement of the ends of the ring in and out.

* * * * *